US008062541B2

(12) United States Patent
Barber et al.

(10) Patent No.: US 8,062,541 B2
(45) Date of Patent: Nov. 22, 2011

(54) NON-SETTLING GLYCOL BASED MAGNETORHEOLOGICAL FLUIDS

(75) Inventors: Daniel E. Barber, Fuquay-Varina, NC (US); Donald A. Nixon, Wilson, NC (US)

(73) Assignee: Lord Corporation, Cary, NC (US)

( * ) Notice: Subject to any disclaimer, the term of this patent is extended or adjusted under 35 U.S.C. 154(b) by 621 days.

(21) Appl. No.: 12/184,508

(22) Filed: Aug. 1, 2008

(65) Prior Publication Data

US 2009/0057602 A1 Mar. 5, 2009

Related U.S. Application Data

(60) Provisional application No. 60/953,272, filed on Aug. 1, 2007.

(51) Int. Cl.
*H01F 1/44* (2006.01)

(52) U.S. Cl. ..... 252/62.52

(58) Field of Classification Search ..... 252/62.52
See application file for complete search history.

(56) References Cited

U.S. PATENT DOCUMENTS

| | | | | |
|---|---|---|---|---|
| 2,751,352 | A | | 6/1956 | Bondi |
| 3,951,881 | A | | 4/1976 | Molina |
| 4,604,222 | A | | 8/1986 | Borduz et al. |
| 5,505,880 | A | | 4/1996 | Kormann et al. |
| 5,670,077 | A | * | 9/1997 | Carlson et al. ..... 252/62.52 |
| 5,985,168 | A | | 11/1999 | Phule |
| 5,989,447 | A | | 11/1999 | Podszun et al. |
| 6,132,633 | A | | 10/2000 | Carlson |
| 6,149,832 | A | | 11/2000 | Foister |
| 6,221,138 | B1 | | 4/2001 | Kenny |
| 6,413,441 | B1 | | 7/2002 | Levin |
| 6,547,986 | B1 | | 4/2003 | Kintz et al. |
| 6,692,650 | B2 | | 2/2004 | Park et al. |
| 6,824,700 | B2 | * | 11/2004 | Iyengar et al. ..... 252/62.52 |
| 7,070,708 | B2 | | 7/2006 | Iyengar et al. |
| 2002/0171067 | A1 | | 11/2002 | Jolly et al. |
| 2004/0084651 | A1 | | 5/2004 | Kintz et al. |
| 2005/0087721 | A1 | | 4/2005 | Iyengar et al. |
| 2005/0242321 | A1 | | 11/2005 | Iyengar et al. |

FOREIGN PATENT DOCUMENTS

| | | |
|---|---|---|
| JP | 08-283766 | 10/1996 |
| WO | WO 94/04313 | 3/1994 |
| WO | 9410692 | 5/1994 |
| WO | 0184567 | 5/2001 |

* cited by examiner

*Primary Examiner* — Carol M Koslow
(74) *Attorney, Agent, or Firm* — Todd W. Galinski

(57) ABSTRACT

A magnetorheological fluid comprising magnetic-responsive particles, a thickener, an ionic thixotropic additive, and a carrier fluid wherein the carrier fluid comprises a glycol-water mixture comprising at least 50 percent by weight of a glycol compound. The thickener is preferably fumed silica and the ionic thixotropic additive is preferably one of sodium nitrite, sodium chloride, sodium acetate, and sodium benzoate.

26 Claims, No Drawings

NON-SETTLING GLYCOL BASED MAGNETORHEOLOGICAL FLUIDS

CROSS REFERENCE TO RELATED APPLICATIONS

The present application claims priority under 35 U.S.C. §119(e) from U.S. Provisional Patent Application Ser. No. 60/953,272 filed Aug. 1, 2007, entitled "NON-SETTLING GLYCOL BASED MAGNETORHEOLOGICAL FLUIDS", the disclosure of which is incorporated herein by reference.

BACKGROUND OF THE INVENTION

Magnetorheological fluids are magnetic field responsive fluids containing a field polarizable particle component and a liquid carrier component. Magnetorheological fluids are useful in devices or systems for controlling vibration and/or noise. Magnetorheological fluids have been proposed for controlling damping in various devices, such as dampers, shock absorbers, and elastomeric mounts. They have also been proposed for use in controlling pressure and/or torque in brakes, clutches, and valves. Magnetorheological fluids are considered superior to electrorheological fluids in many applications because they exhibit higher yield strengths and can create greater damping forces.

The particle component compositions typically include micron-sized magnetic-responsive particles. In the presence of a magnetic field, the magnetic-responsive particles become polarized and are thereby organized into chains of particles or particle fibrils. The particle chains increase the apparent viscosity (flow resistance) of the fluid, resulting in the development of a solid mass having a yield stress that must be exceeded to induce onset of flow of the magnetorheological fluid. The particles return to an unorganized state when the magnetic field is removed, which lowers the viscosity of the fluid.

Magnetorheological (MR) fluids based on hydrocarbon or silicone oils are well-known in the literature and numerous patents, and many device applications based on these fluids are also known. Aqueous magnetorheological fluids are also known, but there are fewer device applications for this fluid because of its limited temperature stability and its lack of lubricity. Hydrocarbon-based magnetorheological fluids have been found to be unsatisfactory in devices that contain natural rubber (e.g., automotive engine mounts) due to an incompatibility between the rubber and the hydrocarbon carrier fluid. Silicone-based fluids are more compatible with the rubber material, but they are generally more expensive and are not as desirable from a user's viewpoint because of the potential for silicone cross-contamination.

Glycol-based fluids are compatible with natural rubber and have acceptable temperature stability without the drawbacks associated with silicone fluids. A patent for glycol-based magnetorheological fluid assigned to Delphi Corporation (U.S. Pat. No. 6,824,700 B2, Glycol-Based MR Fluids with Thickening Agent) uses organoclay as a thickening agent. Such fluids suffer from the drawback that they form a persistent foam when exposed to vacuum, which is a significant problem for vacuum-filling operations typically used by engine mount manufacturers.

The purpose of this invention is to provide a glycol-based fluid with minimal settling that is non-foaming and satisfactory for use in engine mounts or similar devices.

SUMMARY OF THE INVENTION

In an embodiment of the present invention, a magnetorheological fluid is provided comprising a glycol based fluid with fumed silica, an ionic thixotropic additive, and at least some water. Fluids such as these have not been described in the patent literature, which primarily describes hydrocarbon, silicone oil, and aqueous fluids with small amounts of glycol.

In a first aspect of the present invention, a magnetorheological fluid is provided comprising magnetic-responsive particles, a thickener, an ionic thixotropic additive, and a carrier fluid wherein the carrier fluid comprises a glycol-water mixture comprising at least 50 percent by weight of a glycol compound. In one preferred embodiment of the present invention, the carrier fluid comprises a mixture of ethylene and propylene glycol. In another preferred embodiment of the present invention, the water is present in the carrier fluid in an amount up to 50 percent by weight based on the weight of the carrier fluid. In still further preferred embodiments of the present invention, water is present in an amount from about 0.01 to about 10 weight percent, from about 0.1 to about 5 weight percent, and at least 2.0 percent by weight based on the weight of the carrier fluid.

In one embodiment of the present invention, the thickener comprises untreated fumed silica, preferably comprising a BET surface area of 200 $m^2/g$ or less. In alternate preferred embodiments of the present invention, the thickener is present in the magnetorheological fluid at 0.01 to 5.0 percent by weight, at 0.5 to 3.0 percent by weight and at about 1.5 percent by weight based on the total weight of the magnetorheological fluid.

In another embodiment of the present invention, the ionic thixotropic compound comprises the structure $AB_y$, wherein A is a cation with a charge (valence) of +y and B is a monovalent anion. In preferred embodiments of the present invention, the cation comprises at least one of an alkali metal and alkaline earth metal, and the anion comprises at least one of halides, inorganic oxoanions, carboxylates, and alkoxides.

In one embodiment of the present invention, the anion comprises the following formula:

$$R—CO_2^-$$

wherein R comprises an alkyl or aryl group. In one preferred embodiment of the present invention, R comprises $CH_3$ or $C_6H_6$.

In preferred embodiments of the present invention, the ionic thixotropic additive comprises at least one of sodium nitrite and sodium chloride, and/or the ionic thixotropic additive comprises an organic carboxylate salt, sodium acetate and/or sodium benzoate.

In preferred embodiments of the present invention, the ionic thixotropic additive provides an ionic strength of at least about 0.0007 moles ions per gram of carrier fluid, is present in an amount of at least 0.7 weight percent based on the total weight of the magnetorheological composition, is present in an amount of at least 0.01 moles ions per gram fumed metal oxide, is present in an amount effective to provide an excess ionic content relative to the thickener, and/or is present from 0.05 to 5.0 weight percent based on the total weight of the magnetorheological fluid.

In a still further embodiment of the present invention, the magnetically responsive particles are present in an amount from about 15 to about 45 volume percent based on the total volume of the magnetorheological fluid.

The resulting fluids have a unique rheology in comparison to previous glycol fluids that should make them easier for customers to use. The fluids are low foaming and thus an improvement over fluids made with organoclay thickeners. The addition of small quantities of water to the glycol fluids is expected to decrease their low-temperature viscosity. All of these attributes are improvements over the glycol-only fluids described in Delphi patent U.S. Pat. No. 6,824,700 B2.

The rheology of such a fluid is unique in that the fluid at rest has a gel-like structure with a high yield stress, yet upon shearing the yield stress decreases substantially so that the material flows easily. Recovery of the high yield stress requires many minutes to hours, so degassing and filling procedures should be simplified as compared to glycol fluids with other thickeners that recover their yield stress immediately.

DETAILED DESCRIPTION OF THE INVENTION

In a first embodiment of the present invention, a magnetorheological fluid composition is provided comprising magnetic-responsive particles, a carrier fluid comprising a glycol-water mixture comprising at least 50 percent glycol fluid, a thickener, and an ionic thixotropic additive.

The magnetic-responsive particles useful in the present invention may be any solid known to exhibit magnetorheological activity. Typical particle components useful in the present invention are comprised of, for example, paramagnetic, superparamagnetic or ferromagnetic compounds. Specific examples of magnetic-responsive particles which may be used include particles comprised of materials such as iron, iron alloys, iron oxide, iron nitride, iron carbide, carbonyl iron, chromium dioxide, low carbon steel, silicon steel, nickel, cobalt, and mixtures thereof. The iron oxide includes all known pure iron oxides, such as $Fe_2O_3$ and $Fe_3O_4$, as well as those containing small amounts of other elements, such as manganese, zinc or barium. Specific examples of iron oxide include ferrites and magnetites. In addition, the magnetic-responsive particle component can be comprised of any of the known alloys of iron, such as those containing aluminum, silicon, cobalt, nickel, vanadium, molybdenum, chromium, tungsten, manganese and/or copper.

Iron alloys which may be used as the magnetic-responsive particles in the present invention include iron-cobalt and iron-nickel alloys. The iron-cobalt alloys preferred for use in the magnetorheological compositions have an iron:cobalt ratio ranging from about 30:70 to 95:5, and preferably from about 50:50 to 85:15, while the iron-nickel alloys have an iron-nickel ratio ranging from about 90:10 to 99:1, and preferably from about 94:6 to 97:3. The iron alloys may contain a small amount of other elements, such as vanadium, chromium, etc., in order to improve the ductility and mechanical properties of the alloys. These other elements are typically present in an amount that is less than about 3.0 percent by weight.

The most preferred magnetic-responsive particles for use in the present invention are particles with a high iron content, generally greater than or at least about 95 percent iron. Preferably, the magnetic-responsive particles used will have less than about 0.01 percent carbon. In an especially preferred embodiment, the magnetic-responsive particles will contain about 98 percent to about 99 percent iron, and less than about 1 percent oxygen and nitrogen. Such particles may be obtained, for example, by water atomization or gas atomization of molten iron. Iron particles with these characteristics are commercially available.

The particle component according to the invention is typically in the form of a metal powder. The particle size of the magnetic-responsive particles should be selected so that it exhibits multi-domain characteristics when subjected to a magnetic field. Average number particle diameter distribution for the magnetic-responsive particles are generally between about 6 and about 100 microns, preferably between about 10 and about 60 microns. In the most preferred embodiment, the average number particle diameter distribution of the magnetic-responsive powder is about 5 to about 15 microns. The particle component may contain magnetic-responsive particles of a variety of sizes, so long as the average number particle diameter distribution is as set forth. Preferably, the particle component will have at least about 60 percent particles which are at least 16 microns in diameter. Most preferably, the particle component will have at least about 70 percent particles which are at least 10 microns in diameter. The size of the magnetic-responsive particles may be determined by scanning electron microscopy, a laser light scattering technique or measured using various sieves, providing a particular mesh size.

The magnetic-responsive particles of the present invention are preferably spherical in shape, but may also be an irregular or other non-spherical shape. A particle distribution of non-spherical magnetic-responsive particles according to the present invention may have some nearly spherical particles within the distribution. However, more than about 50 to about 70 percent of the particles in the preferred embodiment will have an irregular shape. The most preferred magnetic-responsive particles useful in the present invention are spherical carbonyl iron particles containing at least 99 percent iron.

The magnetic-responsive particles are present in the magnetorheological composition in an amount of about 60 to about 90 percent by weight of the total magnetorheological composition, preferably in an amount of about 65 to about 80 percent by weight.

The carrier fluid comprises at least 50 weight percent of a glycol component based on the weight of the carrier fluid. In a preferred embodiment of the present invention, the glycol component comprises at least one of ethylene glycol, propylene glycol, other commercially available glycols, and their mixtures. In an exemplary embodiment of the present invention, the glycol-based fluid consists essentially of propylene glycol and ethylene glycol. Due to the greater thickening effect observed for propylene glycol, the glycol-based fluid advantageously includes an ethylene glycol to propylene glycol ratio of about 70:30 to about 0:100. In another example of the present invention, the glycol-based fluid comprises at least about 50 weight propylene glycol, the balance ethylene glycol. In another example of the present invention, the glycol-based fluid comprises 100 weight percent propylene glycol.

The amount of water in the carrier fluid will vary depending upon the application. In one embodiment of the present invention, the carrier fluid may comprise almost 50 weight percent water, based on the total weight of the carrier fluid. In a preferred embodiment of the present invention, the water content comprises from about 0.01 weight percent to about 10 weight percent, based on the total weight of the magnetorheological fluid. In an even more preferred embodiment of the present invention the water is present from about 0.1 to about 5 weight percent, based on the total weight of the magnetorheological fluid.

In a further embodiment of the present invention, a thickener is added to improve the viscosity of the fluid and provide anti-settling characteristics. In a preferred embodiment of the present invention the thickener comprises untreated fumed silica. Untreated fumed silica is also known as colloidal silica, synthetic silica, colloidal silicon dioxide, silica colloidalis anhydrica and light anhydrous silicic acid. Untreated fumed silica is the preferred thickener due to its aggregated particle structure, which is formed during the manufacturing process when newly formed molten particles of silicon dioxide collide and form branched chains. When the chains cool, they mix together to form mechanical entanglements which results in a fine, light, powder. Thus, in another embodiment of the present invention, the thickener comprises a metal oxide, preferably a fumed metal oxide, having a similar structure to that of fumed silica.

Among the untreated fumed metal oxide (silica) types, lower surface area is more effective at enhancing anti-settling properties, with BET surface area of 200 $m^2/g$ or less being preferred. As is known in the art the surface area of most metal oxide particles can be determined by the method of S. Brunauer, P. H. Emmet, and I. Teller, J. Am. Chemical Society, 60, 309 (1938), which is commonly referred to as the BET method.

In an embodiment of the present invention, the thickener is employed in an amount ranging from about 0.01 to 5.0 and preferably from about 0.5 to 3.0 percent by volume of the magnetorheological fluid. In another embodiment of the present invention, additional thixotropic agents may be used such as colloidal sized silica particles and similar silicon-containing particles like, aluminosilicates and magnesium silicates.

The ionic thixotropic additive is provided to induce thickening in glycol fluids containing fumed silica. The addition of this additive in conjunction with the fumed silica produces unexpected thickening and further enhanced anti-settling properties.

In one embodiment of the present invention, the ionic thixotropic additive comprises the type $AB_y$, where A is a cation with a charge (valence) of +y and B is a monovalent anion. The ionic compound must be fully soluble in the carrier fluid. Suitable cations include any alkali metal ions or alkaline earth metal ions, $Al^{3+}$, and redox-stable metal ions of the transition-metal series. Suitable monoanions include the halide anions and inorganic oxoanions that are monovalent under the alkaline conditions of the fluid. Other possible anions may include small organic monoanions such as carboxylates and alkoxides, as long as such compounds are soluble in the carrier fluid.

In one preferred embodiment of the present invention, the organic anions have the general formula $R—CO_2^-$ with R comprising $CH_3$ or $C_6H_6$. More generally, R can be any alkyl or aryl group as long as the solubility of the resulting salt in the glycol fluid is sufficient to give the desired settling property. The cation of the organic anion can also be any of the monovalent cations described previously.

In a most preferred embodiment of the present invention, the ionic thixotropic additive comprises at least one of sodium nitrite and sodium chloride. While not wishing to be bound by the theory, the inventors believe that the ions enhance the interaction between the thickener particles. Additionally, it has been found that a certain amount of water is required for the thickening to be effective.

Since the presumed mechanism of action of the ionic compounds is through their ionized forms, the amount of ionic material in the fluid formulation is better defined in terms of ionic strength. Since the ionic strength will vary depending upon the solubility and degree of dissociation of the ionic thixotropic additive, amongst other factors, the raw weight percent of the additive is not necessarily predictive of the amount of ionic material available to enhance and compliment the thickener.

In a preferred embodiment of the present invention, the ionic strength should be at least about 0.0007 moles ions per gram of carrier fluid, or about 0.01 moles ions per gram of fumed metal oxide. As an example, the minimum ionic content is about 0.7 percent by weight of the total formulation for compounds such as NaCl and $NaNO_2$. The maximum useful ionic content would be the saturation point for a given ionic compound and will vary. However, it is within the scope of this invention to provide an excess of ionic thixotropic additive to ensure full ionic availability to the thickener.

In another embodiment of the present invention, the ionic thixotropic additive is present in an amount from 0.05 to 5.0 weight percent, based on the total weight of the composition.

In another embodiment of the present invention, the magnetorheological fluid optionally comprises additional viscosity modifier, additives to limit corrosion including alkyl amines, alkyl alkanolamines, dispersants or surfactants, pH shifters, salts, deacidifiers, antioxidants, or additional lubricants.

In a preferred embodiment of the present invention, the pH of the MR fluid comprises an alkalinity preferably in the range from 8.5 to 11, and more preferably in the range from 9 to 10.5. This can be achieved with any common pH-adjusting agent, include alkali metal and alkaline earth hydroxides, aqueous ammonia, organic amines, or mixtures thereof. Particularly suitable compounds are those that can also act as anti-corrosive agents, such as the alkyl alkanolamine compounds commonly used in antifreeze formulations.

Examples of dispersants include carboxylate soaps such as lithium stearate, lithium hydroxy stearate, calcium stearate, aluminum stearate, ferrous oleate, ferrous naphthenate, zinc stearate, aluminum tristearate and distearate, sodium stearate, strontium stearate and mixtures thereof.

Examples of optional additives that provide antioxidant function include zinc dithiophosphates, hindered phenols, aromatic amines, and sulfurized phenols. Examples of lubricants include organic fatty acids and amides, lard oil, and high molecular weight organophosphorus compounds, phosphoric acid esters. Example synthetic viscosity modifiers include polymers and copolymers of olefins, methacrylates, dienes or alkylated styrenes. In addition, other optional additives providing a steric stabilizing function include fluoroaliphatic polymeric esters, and compounds providing chemical coupling include organotitanate, -aluminate, -silicone, and -zirconate coupling agents.

Examples of rust inhibitors, also known as oxygen scavengers, are well known and typically comprise various nitrite or nitrate compounds. Specific examples of rust inhibitors include sodium nitrite, sodium nitrate, sodium benzoate, borax, ethanolamine phosphate, and mixtures thereof. In addition, other alkalizing agents such as sodium hydroxide may be added to insure that the pH of the magnetorheological material remains alkaline throughout its life. Descriptions of various rust inhibitors for water and water/ethylene glycol mixtures can also be found in (1) H. H. Uhlig and R. W. Revie, "Corrosion and Corrosion Control," Third Edition, John Wiley (1985); (2) M. J. Collie, editor, "Corrosion Inhibitors," Noyes Data Corp. (1983); (3) M. Ash and I. Ash, "Handbook of Industrial Chemical Additives," VCH Publications, New York (1991), section on corrosion inhibitors, pp. 783-785; (4) McCutcheon's "Volume 2: Functional Materials, North American Edition," Mfg. Confectioner Publ. Co. (1992), section on corrosion inhibitors, pp. 73-84; and (5) R. M. E. Diamant, "Rust and Rot," Argus and Robertson, London (1972), pg. 59.

One of skill in the art can readily select optional additive components as desired in a particular formulation. The amount of optional components typically each can range from about 0.25 to about 12 volume percent, based on the total volume of the magnetorheological fluid. Preferably, the optional ingredients each will be present in the range of about 0.5 to about 7.5 volume percent based on the total volume of the magnetorheological fluid.

EXAMPLES

Example 1

| | Volume (ml) | Weight (g) | Weight Percent | Volume Percent |
|---|---|---|---|---|
| Formulation A | | | | |
| Carbonyl iron | 198.00 | 1556.28 | 66.36% | 22.00% |
| Sodium Nitrite | 4.50 | 9.77 | 0.42% | 0.50% |
| Untreated Fumed Silica | 16.02 | 35.24 | 1.50% | 1.78% |
| Deionized Water | 57.60 | 57.60 | 2.46% | 6.40% |
| Glycol Fluid A* | 623.88 | 686.27 | 29.26% | 69.32% |
| Total | 900.0 | 2345.16 | 100.00% | 100.00% |
| Formulation B | | | | |
| Carbonyl iron | 198 | 1556.28 | 66.36% | 22.00% |
| Sodium chloride | 4.5 | 9.77 | 0.42% | 0.50% |
| Untreated Fumed Silica | 16.02 | 35.24 | 1.50% | 1.78% |
| Deionized water | 57.6 | 57.6 | 2.46% | 6.40% |
| Glycol Fluid A* | 623.88 | 686.27 | 29.26% | 69.32% |
| Total | 900 | 2345.16 | 100.00% | 100.00% |

*Glycol Fluid A comprises a 70/30 glycol blend of ethylene glycol and propylene glycol with an alkyl alkanolamine additive.

Fluids made with the formulations described in Example 1 and Example 2 had no clear layer and a consistency like thick yogurt after standing overnight with no agitation. The fluids flowed easily after briefly shaking by hand, and continued to flow easily for at least 10 minutes following agitation.

Example 2

TABLE 1

Effect of Thickener Type

| Formulation | Thickener | Surface Area ($m^2/g$) | 24-hour clear layer |
|---|---|---|---|
| 1 | Fumed Silica-1 | 200 | 0 |
| 2 | Fumed Silica-2 | 150 | 0 |
| 3 | Fumed Silica-3 | 380 | 4 |
| 4 | Colloidal Silica | n/a | 14 |
| 5 | Treated Fumed Silica | 225 | 7 |
| 6 | Treated Fumed Silica | 125 | 24 |
| 7 | Treated Fumed Silica | 100 | 3 |

All of the formulations above were prepared with 66 weight percent carbonyl iron, with 2.45 weight percent water, 1.5 weight percent thickener and 0.83 weight percent NaCl as the ionic thixotropic additive. Their settling properties were tested by allowing the formulation to sit undisturbed for a period of 24 hours in a graduated cylinder. If the iron particles began to settle, a "clear layer" becomes visible at the top of the fluid. The degree of settling corresponds to the percentage of the fluid represented by the clear layer.

The fumed silicas in Formulations 1 and 2 showed no settling over a 24-hour period. The fumed silica of Formulation 3, with a surface area of 380 $m^2/g$, showed slight settling resulting in a 4 percent clear layer.

The colloidal silica of Formulation 4 was not effective, nor were treated fumed silicas that had been surface-modified to have a less-polar surface, as illustrated in Formulations 5-7. Treated fumed silicas also cause the fluid to retain air, which is undesirable and can lead to foaming.

Thus, there has been outlined, rather broadly, the more important features of the invention in order that the detailed description that follows may be better understood and in order that the present contribution to the art may be better appreciated. There are, obviously, additional features of the invention that will be described hereinafter and which will form the subject matter of the claims appended hereto. In this respect, before explaining several embodiments of the invention in detail, it is to be understood that the invention is not limited in its application to the details and construction and to the arrangement of the components set forth in the following description. The invention is capable of other embodiments and of being practiced and carried out in various ways.

It is also to be understood that the phraseology and terminology herein are for the purposes of description and should not be regarded as limiting in any respect. Those skilled in the art will appreciate the concepts upon which this disclosure is based and that it may readily be utilized as the basis for designating other structures, methods and systems for carrying out the several purposes of this development. It is important that the claims be regarded as including such equivalent constructions insofar as they do not depart from the spirit and scope of the present invention.

What is claimed is:

1. A magnetorheological fluid comprising magnetic-responsive particles, a thickener comprising an untreated fumed metal oxide, an ionic thixotropic additive, and a carrier fluid wherein the carrier fluid comprises a glycol-water mixture comprising at least 50 percent by weight of a glycol compound.

2. The magnetorheological fluid of claim 1, wherein the carrier fluid comprises a mixture of ethylene and propylene glycol.

3. The magnetorheological fluid of claim 1, wherein the water is present in the carrier fluid in an amount up to 50 percent by weight based on the weight of the carrier fluid.

4. The magnetorheological fluid of claim 1, wherein water is present in an amount from about 0.01 to about 10 weight percent, based on the total weight of the magnetorheological fluid.

5. The magnetorheological fluid of claim 1, wherein water is present in an amount from about 0.1 to about 5 weight percent, based on the total weight of the magnetorheological fluid.

6. The magnetorheological fluid of claim 1, wherein the water is present in the carrier fluid in an amount of at least 2.0 percent by weight based on the weight of the carrier fluid.

7. The magnetorheological fluid of claim 1, wherein the thickener comprises untreated fumed silica.

8. The magnetorheological fluid of claim 1, wherein the thickener comprises a BET surface area of 200 $m^2/g$ or less.

9. The magnetorheological fluid of claim 1, wherein the thickener is present in the magnetorheological fluid at 0.01 to 5.0 percent by weight based on the total weight of the magnetorheological fluid.

10. The magnetorheological fluid of claim 1, wherein the thickener is present in the magnetorheological fluid at 0.5 to 3.0 percent by weight based on the total weight of the magnetorheological fluid.

11. The magnetorheological fluid of claim 1, wherein the thickener is present in the magnetorheological fluid at about 1.5 percent by weight based on the total weight of the magnetorheological fluid.

12. The magnetorheological fluid of claim 1, wherein the ionic thixotropic compound comprises the structure $AB_y$, wherein A is a cation with a charge (valence) of +y and B is a monovalent anion.

13. The magnetorheological fluid of claim 12, wherein the cation comprises at least one of an alkali metal and alkaline earth metal.

14. The magnetorheological fluid of claim 12, wherein the anion comprises at least one of halides, inorganic oxoanions, carboxylates, and alkoxides.

15. The magnetorheological fluid of claim 12, wherein the anion comprises the following formula:

$$R—CO_2^-$$

wherein R comprises an alkyl or aryl group.

16. The magnetorheological fluid of claim 15, wherein R comprises $CH_3$ or $C_6H_6$.

17. The magnetorheological fluid of claim 1, wherein the ionic thixotropic additive comprises at least one of sodium nitrite and sodium chloride.

18. The magnetorheological fluid of claim 1, wherein the ionic thixotropic additive comprises an organic carboxylate salt.

19. The magnetorheological fluid of claim 1, wherein the ionic thixotropic additive comprises sodium acetate.

20. The magnetorheological fluid of claim 1, wherein the ionic thixotropic additive comprises sodium benzoate.

21. The magnetorheological fluid of claim 1, wherein the ionic thixotropic additive provides an ionic strength of at least about 0.0007 moles ions per gram of carrier fluid.

22. The magnetorheological fluid of claim 1, wherein the ionic thixotropic additive is present in an amount of at least 0.7 weight percent based on the total weight of the magnetorheological composition.

23. The magnetorheological fluid of claim 1, wherein the ionic thixotropic additive is present in an amount of at least 0.01 moles ions per gram fumed metal oxide.

24. The magnetorheological fluid of claim 1, wherein the ionic thixotropic additive is present in an amount effective to provide an excess ionic content relative to the thickener.

25. The magnetorheological fluid of claim 1, wherein the ionic thixotropic additive is present from 0.05 to 5.0 weight percent based on the total weight of the magnetorheological fluid.

26. The magnetorheological fluid of claim 1, wherein the magnetically responsive particles are present in an amount from about 15 to about 45 volume percent based on the total volume of the magnetorheological fluid.

* * * * *